US011658421B2

(12) United States Patent
Attaja et al.

(10) Patent No.: US 11,658,421 B2
(45) Date of Patent: May 23, 2023

(54) ANTENNA WITH IMPROVED COVERAGE OVER A WIDER FREQUENCY BAND

(71) Applicants: ARIANEGROUP SAS, Paris (FR); CENTRE NATIONAL DE LA RECHERCHE SCIENTIFIQUE, Paris (FR); UNIVERSITE DE RENNES 1, Rennes (FR)

(72) Inventors: Nicolas Attaja, Paris (FR); Mauro Ettorre, Paris (FR); Ronan Sauleau, Rennes (FR); Davy Guihard, Paris (FR)

(73) Assignees: ARIANEGROUP SAS, Paris (FR); CENTRE NATIONAL DE LA RECHERCHE SCIENTIFIQUE, Paris (FR); UNIVERSITE DE RENNES 1, Rennes (FR)

( * ) Notice: Subject to any disclaimer, the term of this patent is extended or adjusted under 35 U.S.C. 154(b) by 0 days.

(21) Appl. No.: 17/466,107

(22) Filed: Sep. 3, 2021

(65) Prior Publication Data

US 2022/0085500 A1 Mar. 17, 2022

(30) Foreign Application Priority Data

Sep. 11, 2020 (FR) ..... 2009240

(51) Int. Cl.

| | |
|---|---|
| ***H01Q 9/28*** | (2006.01) |
| ***H01Q 1/28*** | (2006.01) |
| ***H01Q 21/26*** | (2006.01) |
| ***H01Q 21/30*** | (2006.01) |
| ***H01Q 19/10*** | (2006.01) |

(52) U.S. Cl.

CPC ..... *H01Q 9/285* (2013.01); *H01Q 1/288* (2013.01); *H01Q 19/108* (2013.01); *H01Q 21/26* (2013.01); *H01Q 21/30* (2013.01)

(58) Field of Classification Search

CPC ..... H01Q 1/28; H01Q 1/288; H01Q 1/521; H01Q 5/28; H01Q 5/342; H01Q 5/42; H01Q 5/48; H01Q 9/285; H01Q 13/18; H01Q 19/108; H01Q 21/26; H01Q 21/30

See application file for complete search history.

(56) References Cited

U.S. PATENT DOCUMENTS 4,042,935 A 8/1977 Ajioka et al.
4,183,027 A 1/1980 Ehrenspeck
(Continued)

FOREIGN PATENT DOCUMENTS

FR 2841390 A1 12/2003
FR 2854737 A1 11/2004

OTHER PUBLICATIONS

French Search Report in corresponding French Patent Application No. 2009240, dated May 20, 2021 (2 pages).
(Continued)

*Primary Examiner* — Robert Karacsony
(74) *Attorney, Agent, or Firm* — Bookoff McAndrews, PLLC

(57) ABSTRACT

The invention relates to an antenna comprising a radiative antenna element able to emit a signal in at least two disjoint frequency bands and a waveguide covered by the radiative antenna element, comprising two nested resonant cavities, each single-mode or mostly single-mode in a separate frequency band.

9 Claims, 4 Drawing Sheets

(56) References Cited

U.S. PATENT DOCUMENTS

| | | | | |
|---|---|---|---|---|
| 5,548,299 | A | 8/1996 | Tsuda et al. | |
| 5,995,058 | A * | 11/1999 | Legay | H01Q 5/40 343/789 |
| 9,184,504 | B2 * | 11/2015 | Tatarnikov | H01Q 9/0464 |

OTHER PUBLICATIONS

Matjaz Vidmar "S53MV Weatherproof UHF & microwave cavity antennas", http://lea.hamradio.si/~s53mv/wumca/archery.html, (6 pages) (retrieved May 16, 2021).

* cited by examiner

[Fig. 1]
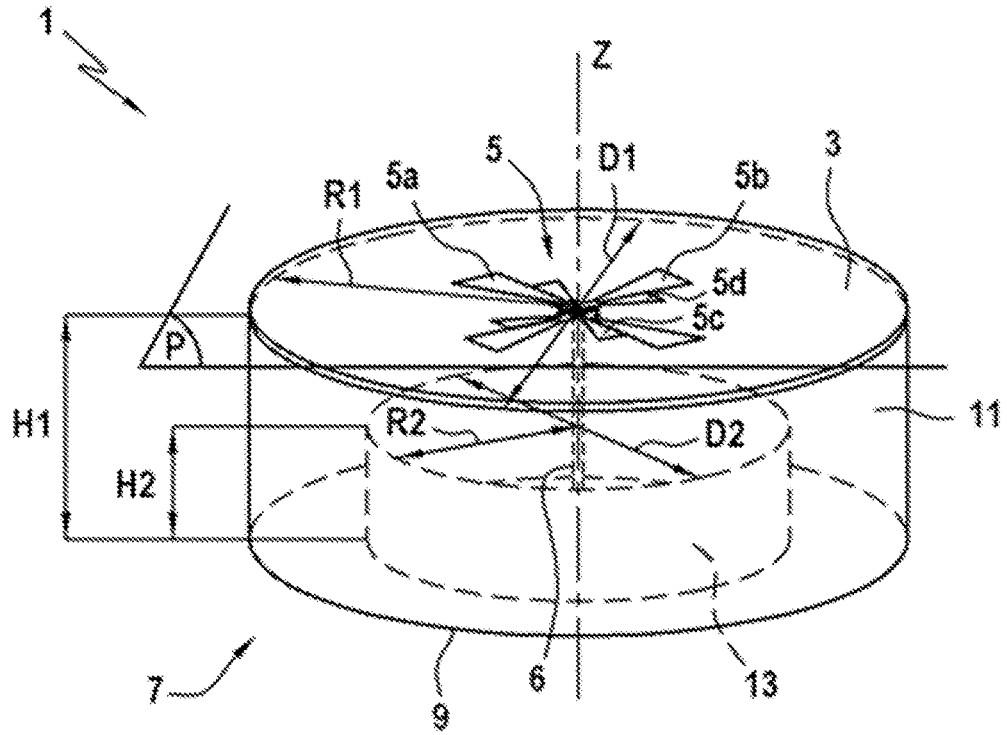
[Fig. 2]
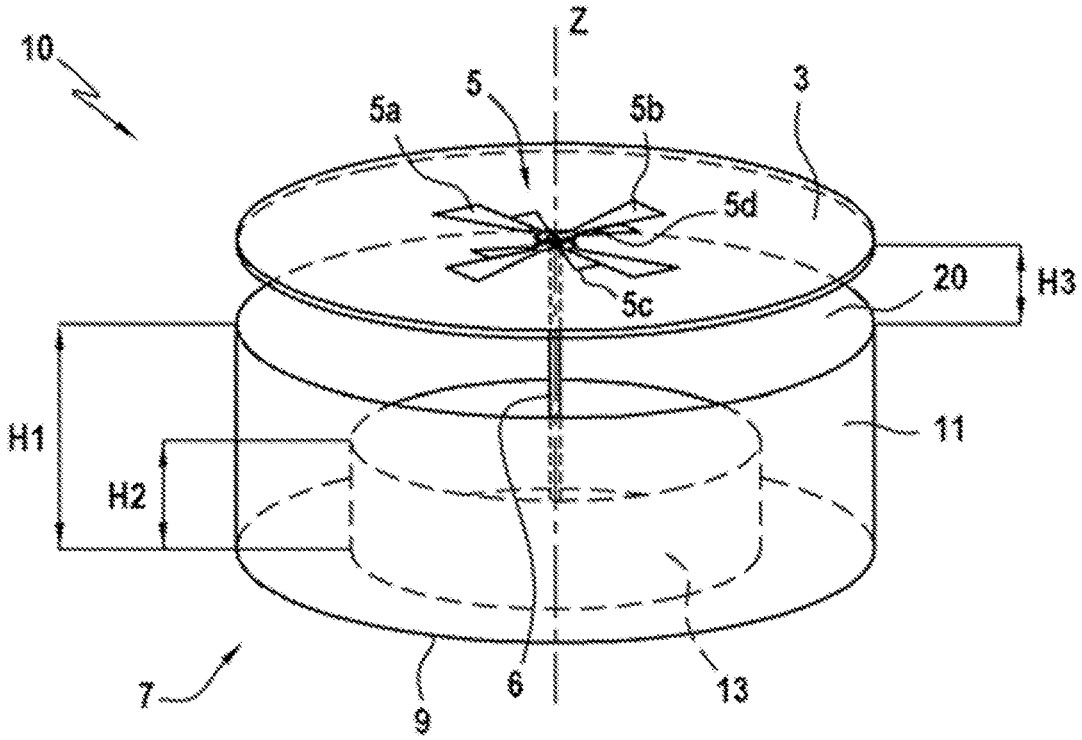

[Fig. 3]
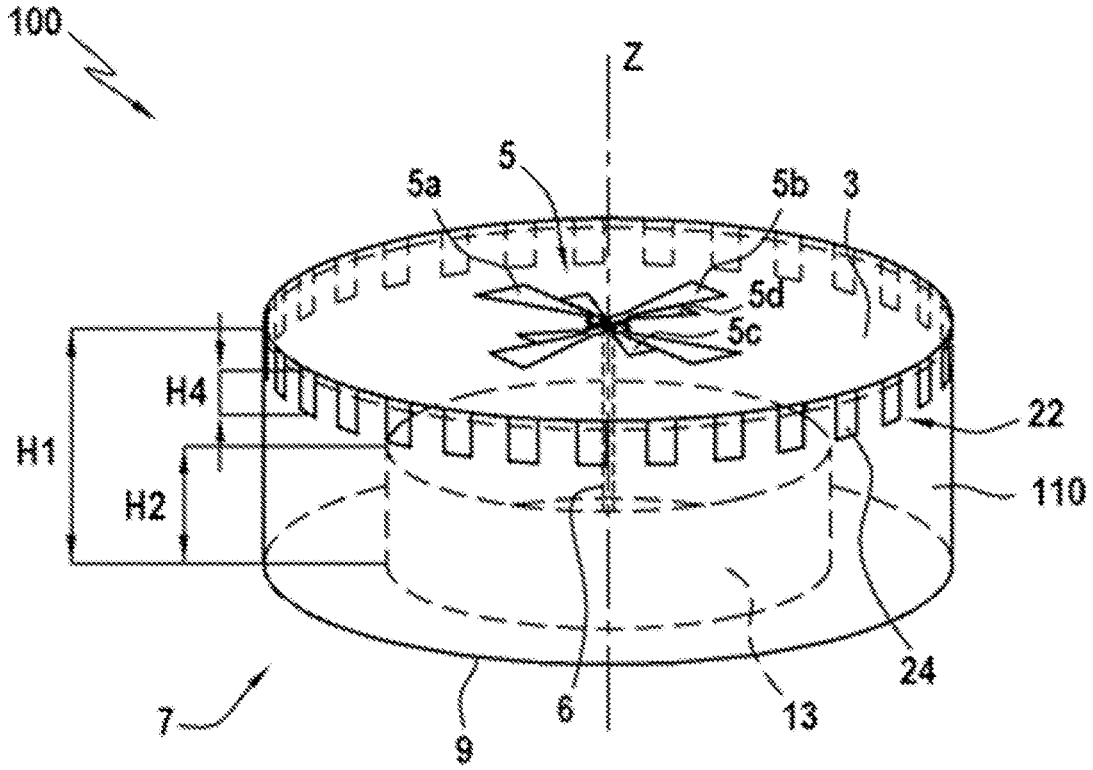
[Fig. 4]
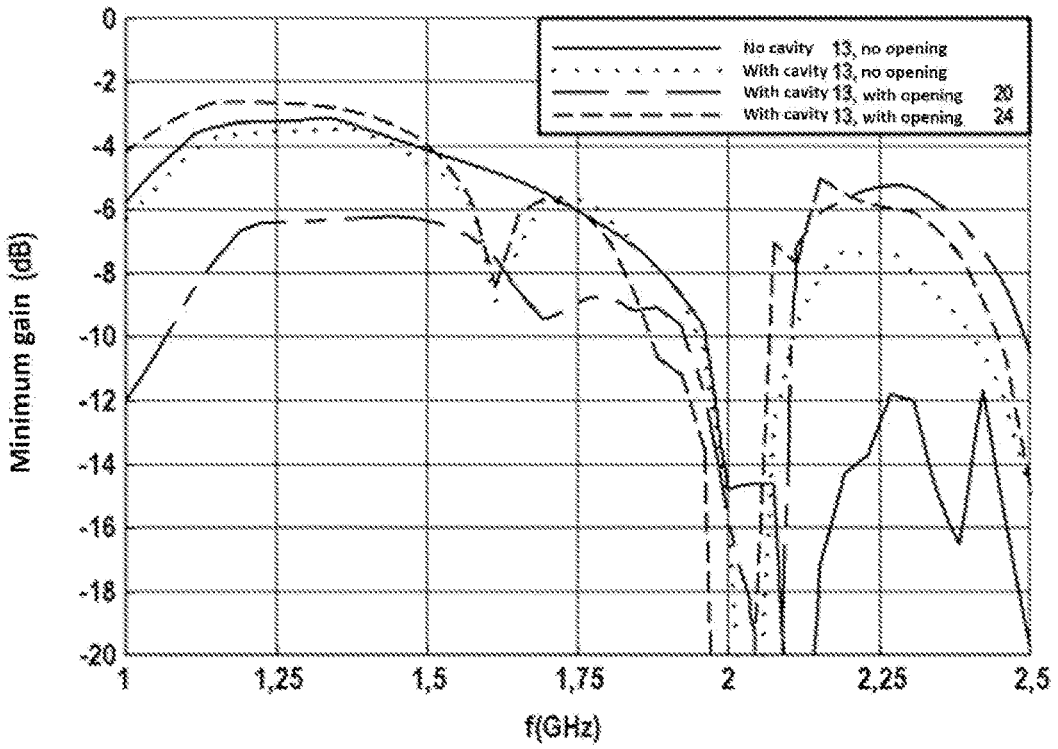

[Fig. 5]
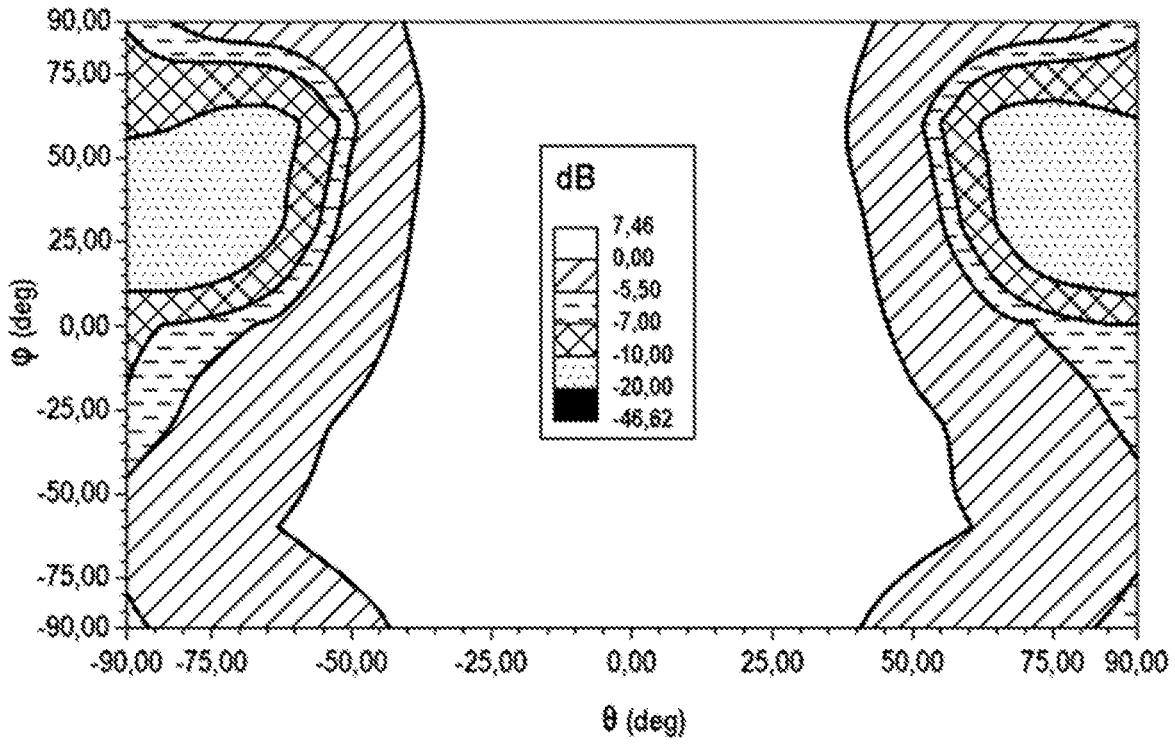
[Fig. 6]
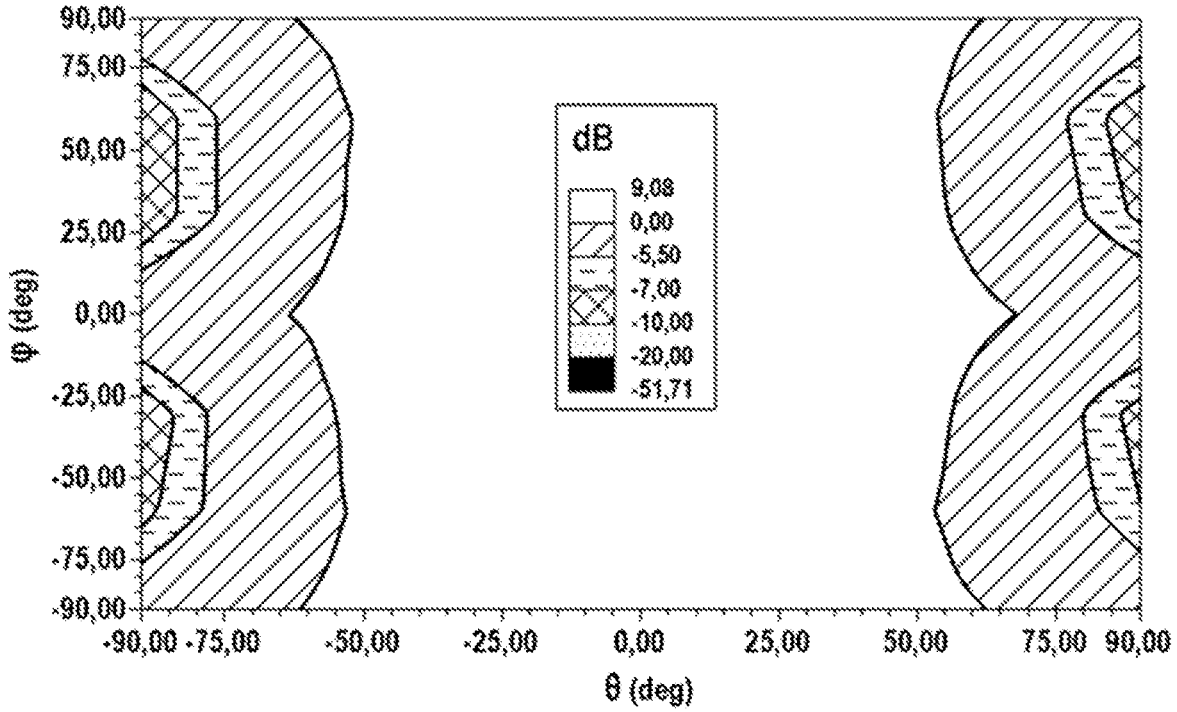

[Fig. 7]
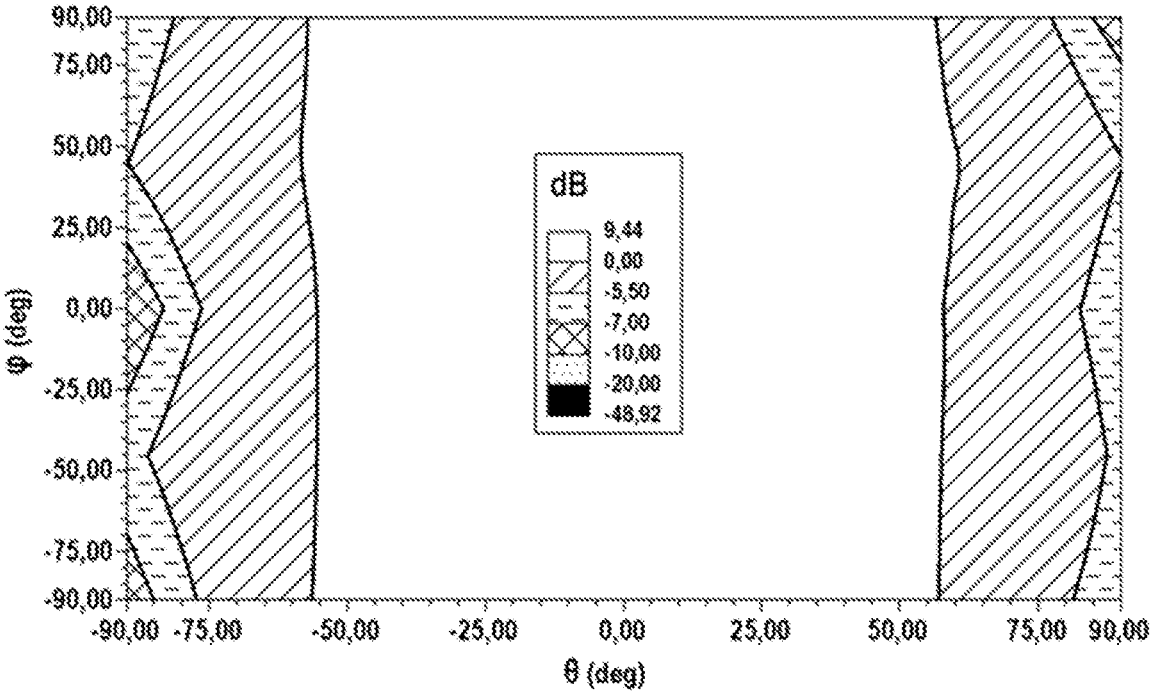

ANTENNA WITH IMPROVED COVERAGE OVER A WIDER FREQUENCY BAND

CROSS-REFERENCE TO RELATED APPLICATIONS

This patent application claims the benefit under 35 U.S.C. § 119 to French Patent Application No. 2009240, filed on Sep. 11, 2020, the entirety of which is incorporated herein by reference.

TECHNICAL FIELD

This invention relates to an antenna able to emit with wide coverage in several frequency bands allowing it to fulfil on its own several separate communication functions.

PRIOR ART

Spacecraft are equipped with antenna which during the flight phases provide communication between these craft and the ground stations.

These antennas are particularly used for telemetry, trajectography, or satellite positioning systems (Global Navigation Satellite System or GNSS). The fulfilment of these functions can require the use of a complex system of several antennas, each associated with a particular function, these antennas each emitting in separate frequency ranges.

It is consequently desirable to dispose of an antenna able to emit with improved coverage in several separate frequency bands to fulfil several communication functions while remaining of a limited bulk and a simple system.

SUMMARY OF THE INVENTION

This invention relates to an antenna comprising:

- a radiative antenna element able to emit a signal in at least a first frequency band and in a second frequency band, disjoint from the first band and at a higher frequency than the latter, and
- a waveguide covered by the radiative antenna element, comprising at least a first resonant and single mode cavity or mostly single-mode cavity in the first frequency band, and a second resonant cavity separate from the first resonant cavity and located inside the latter, said second resonant cavity being single-mode or mostly single-mode in the second frequency band.

The term "single-mode" should be understood to mean that only the fundamental mode of the resonant cavity under consideration can propagate. The term "mostly single-mode" should be understood to mean that the resonant cavity under consideration is single-mode over at least 50%, for example at least 75%, of the frequency band under consideration. In this case, the resonant cavity may not be single-mode over at least one end of the frequency band, and it can be modeless or dual-mode at this end.

The use of the first resonant cavity alone makes it possible to widen the emission frequency spectrum but allows the excitation of higher-order resonant modes which can disrupt the radiation diagram in the second frequency band, in particular at low angles of elevation. The addition of the second resonant cavity inside the first resonant cavity advantageously makes it possible to obtain an improved gain in the second frequency band, in particular at low angles of elevation, by not allowing the propagation of these higher-order modes while remaining limited bulk and a simple system, without modification of the dimensions of the antenna with respect to the sole presence of the first cavity. The invention thus provides an antenna with improved coverage in several separate frequency bands for the fulfilment of several communication functions.

In an exemplary embodiment, the radiative antenna element is present on a substrate covering the waveguide, and the antenna has one or more openings between a wall delimiting the first cavity and the substrate.

Such a feature makes it possible to obtain an improved gain at low angles of elevation in the second frequency band.

In particular, an edge of said wall located on the side of the substrate can have a castellation shape thus defining a plurality of openings between said wall and the substrate.

Such a feature makes it possible to obtain an improved gain at low angles of elevation in the second frequency band while limiting the drop-in gain in the first frequency band.

In an exemplary embodiment, a ratio RA1 H1/H2 is between 1 and 3.25, where H1 denotes a height of the first cavity and H2 a height of the second cavity.

Such a feature makes it possible to yet further improve the gain at the low angles of elevation in the second frequency band.

An optimum height for the second cavity H2 providing optimal gain at the low angles of elevation in the second frequency band can be determined by a parametric study. In this regard, the ratio RA1 is preferably between 1.28 and 2.2.

In an exemplary embodiment, the first frequency band corresponds to the frequencies between 1164 MHz and 1591 MHz and the second frequency band corresponds to the frequencies between 2200 MHz and 2290 MHz.

According to this example, the first frequency band corresponds to the application relating to satellite positioning systems (GNSS) and the second frequency band to telemetry applications.

The invention also relates to a craft equipped with at least one antenna as described above. The craft can be a spacecraft, such as a space launcher, an exploration craft or a satellite. The use of the described antenna is not limited to a space application, as it can be used on other craft such as a train, a motor vehicle or an aircraft.

BRIEF DESCRIPTION OF THE DRAWINGS

FIG. 1 represents a first example of an antenna according to the invention.

FIG. 2 represents a second example of an antenna according to the invention.

FIG. 3 represents a third example of an antenna according to the invention.

FIG. 4 is a comparative diagram showing the gain obtained as a function of frequency for antenna according to the invention and an antenna not part of the invention.

FIG. 5 is a diagram showing the gain obtained in the second frequency band for an antenna not part of the invention.

FIG. 6 is a diagram showing the gain obtained in the second frequency band for an antenna according to the invention.

FIG. 7 is a diagram showing the gain obtained in the second frequency band for another antenna according to the invention.

DESCRIPTION OF THE EMBODIMENTS

FIG. 1 represents a first example of an antenna 1 according to the invention comprising a substrate 3 on which is present a radiative antenna element 5. The substrate 3 can be a dielectric substrate. The substrate 3 can be made of a composite material, for example reinforced with glass. A substrate 3 can be used marketed under the reference RO3210® by the company ROGERS Corporation. The substrate 3 can have a planar shape. Note however that the presence of the substrate 3 is not necessary, the radiative antenna element being able, in a variant, to be formed by a self-supporting metallic part.

The radiative element 5 is, in the illustrated example, of twin crossed dipole or dual-band crossed asymmetric dipole type and comprises a first pair of dipoles 5*a* and 5*b* which are mutually perpendicular and powered with a phase offset of 90°, and a second pair of dipoles 5*c* and 5*d*, separate from the first pair, which are mutually perpendicular and powered with a phase offset of 90°. The dipoles 5*a* and 5*b* of the first pair are of a different length from the dipoles 5*c* and 5*d* of the second pair. The dipoles 5*a*-5*d* of the first and second pairs each have a trapezoid shape in the illustrated example. The dipoles 5*a*-5*d* form in the illustrated example a radiative element 5 having a bow-tie structure. The dipoles 5*a*-5*d* are present on either side of the substrate (on the upper face and on its lower opposite face). The radiative element 5 is able to emit a signal in the radio frequency spectrum, this signal having a circular polarization in at least a first frequency band and in a second frequency band, disjoint from the first band and at a higher frequency than the latter. By way of example, the first frequency band may correspond to frequencies between 1164 MHz and 1591 MHz and the second frequency band to the frequencies between 2200 MHz and 2290 MHz. A coaxial cable 6 powers the radiative element 5. The radiative element 5 of twin crossed dipole or dual-band crossed asymmetric dipole type is known per se. However, the invention is not limited to this type of radiative element, and in a variant it is possible to use a radiative element formed by a crossed dipole or other types of dual-band or broadband radiative elements such as crossed dipoles coupled to resonators, for example. The radiative element 5 may have a planar shape, as illustrated. The radiative element 5 can be devoid of vertical elements, directed along the direction Z, perpendicular to the plane P containing the radiative element 5 and the substrate 3 in the illustrated example.

The radiative element 5 covers a waveguide 7. The waveguide 7 comprises in its lower part, or at its base, a reflector 9. In the absence of the waveguide 7 and of the reflector 9 the radiative element 5 emits a signal having a circular polarization upward along the direction Z shown but also downward with an opposite direction of polarization. The reflector 9 makes it possible to obtain a one-directional circular polarization signal along the direction Z, here only directed upward (in the direction opposite the reflector 9), by reflecting the signal component emitted downward and reversing its direction of polarization due to this reflection.

The waveguide 7 comprises a first resonant cavity 11 which is single-mode or mostly single-mode in the first frequency band. The first resonant cavity 11 may not be single-mode, or mostly single-mode, in the second frequency band. The waveguide 7 further comprises a second resonant cavity 13 which is separate from the first cavity 11 and nested in the latter. The second resonant cavity 13 is single-mode or mostly single-mode in the second frequency band. The second cavity 13 may not be single-mode or mostly single-mode in the first frequency band. The first cavity 11 participates in increasing the gain in the upper half-sphere, owing to the presence of the reflector 9 which reflects the waves upward, thus increasing the gain in the upper half-sphere, and in widening the frequency band in which the antenna 1 emits by allowing the generation of a second circularly polarized signal in addition to the signal generated by the radiative element and corresponding to a separate frequency range. If only the first cavity 11 is used, there is a generation of higher-order modes beyond the cut-off frequency of the second mode TM01 which disrupts the gain in the second frequency band, in particular at low angles of elevation. The addition of the second cavity 13 allows a significant improvement of the gain at the low angles of elevation in the second frequency band by only allowing the excitation of the first modes in the second frequency band.

The radiative element 5 is located above the first 11 and second 13 cavities on the side opposite the reflector 9. The waveguide 7 is, in the illustrated example, closed in its lower part by the reflector 9 which defines a base shared by the first 11 and second 13 cavities and delimits these latters. The reflector 9 is in contact with the first 11 and second 13 cavities. The waveguide 7 is open in its upper part, opposite the reflector 9, in the absence of the radiative element 5 and the substrate 3. The first 11 and second 13 cavities are closed in their lower part by the reflector 9 and closed laterally, and are open in their upper part opposite the reflector 9, in the absence of the radiative element 5 and the substrate 3. The first 11 and second 13 cavities are located below the radiative element 5. In the illustrated example, the substrate 3 positioned on the waveguide 7 closes the latter and the first cavity 11 by coming into contact with this latter. The invention does not require such a contact as will be described below. The assembly of the first 11 and second 13 cavities and the reflector 9 can be entirely metallic. The first cavity 11 has greater dimensions than the second cavity 13. The second cavity 13 has a height H2 less than or equal to the height H1 of the first cavity 11. The greatest dimension D1 of the first cavity 11 is greater than the greatest dimension D2 of the second cavity 13. These greatest dimensions D1 and D2 can be diameters in the illustrated example of a circular geometry for the first 11 and second 13 cavities. The second cavity 13 is centered with respect to the first cavity 11. In the illustrated example, the first and second cavities each have a circular shape, but it does not depart from the scope of the invention when these latters have a different shape, such as a polygonal shape, for example rectangular or octagonal, as will be described below. The walls of the first 11 and second 13 cavities can be solid, i.e. devoid of any slots or material lacks. The coaxial cable 6 extends inside the first 11 and second 13 cavities through these latters.

As stated above, the ratio RA1 H1/H2 can be between 1 and 3.25, for example between 1.28 and 2.2.

According to an example, the ratio RA2 D1/D2 can be between 1.19 and 2.1. The modification of the ratio RA2 is used to modulate the frequency bands in which the antenna 1 emits as a function of the desired application.

The first 11 and second 13 cavities are dimensioned such as to be single-mode or mostly single-mode in the first frequency band and in the second frequency band respectively. The choice of the dimensions to use to realize this is part of the general knowledge of those skilled in the art. For example, the radii of the cavities 11 and 13 can be defined as a function of the cut-off frequencies of a circular waveguide calculated using the formula below.

$$f_{c,mn} = \frac{p'_{nm}}{2\pi a\sqrt{\varepsilon\mu}} \quad \text{[Math. 1]}$$

In the formula above $p'_{nm}$ denote the roots of the first-kind Bessel functions, a the radius of the desired waveguide, E and p the dielectric permittivity and the magnetic permeability of the medium respectively. The parameters n and m correspond to the order of the mode guided by the section of the cavity, here circular.

By way of example for a first frequency band ranging from 1164 MHz to 1591 MHz and a second frequency band ranging from 2200 MHz to 2290 MHz, one may use a waveguide 7 having a radius R1 between 125 mm and 155 mm, for example between 135 mm and 150 mm, a radius R2 between 75 mm and 105 mm, for example between 80 mm and 95 mm, a height H1 between 35 mm and 60 mm, for example between 45 mm and 55 mm, and a height H2 between 25 mm and 40 mm, for example between 25 mm and 35 mm. Unless otherwise specified, the radii R1 and R2 are respectively taken as being equal to half the greatest dimension of the first and of the second cavity and do not necessarily imply that the waveguide is of circular geometry. These values have been determined taking a dielectric permittivity and a magnetic permeability of the medium filling the cavities equal to 1 (vacuum permittivity and permeability).

By way of example for a first frequency band ranging from 1164 MHz to 1591 MHz and a second frequency band ranging from 2200 MHz to 2290 MHz, one can use a waveguide 7 having a radius R1 of 140 mm, a radius R2 of 90 mm, a height H1 between 35 mm and 60 mm, for example between 45 mm and 55 mm, and a height H2 between 25 mm and 40 mm, for example between 25 mm and 35 mm.

Still by way of example for a first frequency band ranging from 1164 MHz to 1591 MHz and a second frequency band ranging from 2200 MHz to 2290 MHz, one can use a waveguide 7 having a height H1 of 50 mm, a height H2 of 25 mm, a radius R1 between 125 mm and 155 mm, for example between 135 mm and 150 mm, and a radius R2 between 75 mm and 105 mm, for example between 80 mm and 95 mm.

FIG. 2 represents a second example of an antenna 10 according to the invention which differs from the example of FIG. 1 only in that an opening 20 is present between the first cavity 11 and the substrate 3. The same reference symbols have been re-used for similar elements. The opening 20 extends 360° around the axis of the first 11 and second 13 cavities, corresponding to the axis Z. The height H3 of the opening 20 can be less than or equal to H1-H2, for example less than or equal to 25 mm, for example between 0.25 mm and 25 mm. The increase in H3 makes it possible to further improve the gain for low angles of elevation in the second frequency band. It is however preferable to not increase H3 too much in order not to decrease the gain in the first frequency band too much. According to the gain requirements of the two frequency bands, this parameter H3 offers an additional degree of freedom to optimize the antenna. In this example, the substrate 3 is not in contact with the first cavity 11 and is present at a predetermined non-zero distance therefrom.

FIG. 3 represents a third example of an antenna 100 according to the invention which differs from the example of FIG. 1 only in that an edge 22 of the wall 110 of the first cavity has a castellated shape defining a plurality of openings 24 between the substrate 3 and the wall 110. The openings 24 may each have the same shape and/or the same dimensions. In a variant, the openings 24 differ in terms of shape and/or dimensions. The openings 24 can as illustrated be present all around the axis Z of the first and second cavities (360° around this axis Z). The openings 24 may or may not be regularly distributed around the axis Z of the first and second cavities. As described above, the height H4 of the openings 24 may be less than or equal to H1-H2, for example less than or equal to 25 mm, for example between 0.25 mm and 25 mm. As above for the case of the opening 20, increasing H4 makes it possible to further improve the gain for the low angles of elevation in the second frequency band. It is however preferable not to increase H4 too much in order not to decrease the gain in the first frequency band too much. Note that the openings 24 have the same effects as the opening 20 but having a lesser impact on the gain of the first frequency band (increasing the height of the openings 24 provides less of a decrease in gain in the first frequency band).

We have just described examples of waveguides having a circular geometry but it does not depart from the scope of the invention when the waveguide has another geometry such as a polygonal shape, for example rectangular or orthogonal. Those skilled in the art know how to dimension resonant cavities for geometries other than circular using other formulae than the formula [Math. 1] indicated above for the circular case. Furthermore, the examples that have just been described comprise only two resonant cavities 11 and 13 but it does not depart from the scope of the invention if the waveguide comprises more than two resonant cavities, for example three nested resonant cavities, the third resonant cavity being single-mode or mostly single-mode in a third frequency band disjoint from the first and second frequency bands. This makes it possible to have an antenna emitting with an improved gain in more than two frequency bands.

FIG. 4 represents a diagram showing the gain as a function of the frequency for θ=90° with respect to the direction Z, corresponding to the horizon therefore to an angle of elevation of 0°. This figure highlights the minimum value of the gain, all azimuthal angles taken together. The diagram is a comparative diagram showing the effect of the addition of the second cavity 13 into a first cavity 11 or 110, and showing the influence of the presence of the openings 20 or 24. The first 11 or 110 and second 13 cavities being both in this test of circular geometry as in FIGS. 1 to 3, with a radius R1=140 mm, a radius R2=90 mm, a height H1=50 mm and a height H2=25 mm. The opening 20 has a height H3 of 10 mm and the openings 24 a height H4 of 15 mm. The curve A1 corresponds to the gain obtained with the first 11 and second 13 cavities without opening as in FIG. 1, the curve A2 to the gain obtained with the opening 20 as in FIG. 2, the curve A3 to the gain obtained with the opening 24 as in FIG. 3 and the curve B corresponds to the gain obtained without the second cavity 13, with the first cavity 11 only. A significant improvement is found in the gain in the second frequency band between 2200 MHz and 2290 MHz when the second cavity 13 is present. Furthermore, an additional improvement of the gain is also found in the second frequency band when the openings 20 and 24 are present.

FIG. 5 represents a gain diagram with a frequency of 2300 MHz as a function of the angle θ with respect to the direction Z on the abscissae, θ=90° corresponding to the horizon, so to an angle of elevation of 0°, and of the azimuth on the ordinate. The evaluated antenna included a radiative antenna element of twin crossed dipole type present on a substrate marketed under the reference RO3210® by the company ROGERS Corporation and had only a first resonant cavity (no second cavity) of square shape with a side of 140 mm and a height of 50 mm.

FIG. 6 shows the gain diagram obtained at this frequency for an antenna identical to that of FIG. 5 but which further comprised a second cavity inside the first cavity. The second cavity had a square shape with a side of 90 mm and a height of 25 mm. A significant improvement of the gain was found for low angles of elevation.

FIG. 7 shows the gain diagram obtained at this frequency for an antenna which had a first and a second cavity of octagonal shape. The first cavity had a greatest dimension of 140 mm and a height of 50 mm and the second cavity had a greatest dimension of 90 mm and a height of 25 mm. A significant improvement in the gain was also found for low angles of elevation by comparison with the case of FIG. 5.

The expression "between . . . and . . . " must be understood as including the bounds.

The invention claimed is:

1. An antenna comprising:

a radiative antenna element able to emit a signal in at least a first frequency band and in a second frequency band, disjoint from the first band and at a higher frequency than the first band, and a waveguide covered by the radiative antenna element, comprising at least a first resonant and single mode or mostly single-mode cavity and a second resonant cavity separate from the first resonant cavity and located inside the latter, said second resonant cavity being single-mode or mostly single-mode in the second frequency band, wherein a ratio RA1 H1/H2 is between 1 and 3.25, where H1 denotes a height of the first cavity and H2 denotes a height of the second cavity.

2. The antenna as claimed in claim 1, wherein the radiative antenna element is present on a substrate covering the waveguide, and wherein the antenna has one or more openings between a wall delimiting the first cavity and the substrate.

3. The antenna as claimed in claim 2, wherein an edge of said wall located on the side of the substrate has a castellation shape thus defining a plurality of openings between said wall and the substrate.

4. The antenna as claimed in claim 1, wherein the first frequency band corresponds to the frequencies between 1164 MHz and 1591 MHz and the second frequency band corresponds to the frequencies between 2200 MHz and 2290 MHz.

5. A craft equipped with at least one antenna as claimed in claim 1.

6. The craft as claimed in claim 5, wherein the craft is a spacecraft.

7. The craft as claimed in claim 6, wherein the craft is a space launcher, an exploration craft or a satellite.

8. The antenna as claimed in claim 1, wherein the waveguide is closed in its lower part by a reflector which defines a base shared by the first and second cavities and delimits them.

9. The antenna as claimed in claim 1, wherein the ratio RA1 is between 1.28 and 2.2.

* * * * *